US012773617B2

(12) United States Patent
Lefebvre et al.

(10) Patent No.: US 12,773,617 B2
(45) Date of Patent: Oct. 27, 2026

(54) HOCKEY GOALIE LEG PAD WITH TOE BRIDGE MEMBER FOR ENGAGING A GOAL POST

(71) Applicant: LES EQUIPEMENTS DE GARDIEN DE BUT MICHEL LEFEBVRE ULC, Calgary (CA)

(72) Inventors: Patrick Lefebvre, Mascouche (CA); Sébastien Morin, Mascouche (CA); Maverick Charles, Mascouche (CA)

(73) Assignee: LES EQUIPEMENTS DE GARDIEN DE BUT MICHEL LEFEBVRE ULC, Calgary (CA)

( * ) Notice: Subject to any disclaimer, the term of this patent is extended or adjusted under 35 U.S.C. 154(b) by 0 days.

(21) Appl. No.: 19/454,554

(22) Filed: Jan. 21, 2026

(65) Prior Publication Data

US 2026/0273378 A1 Sep. 17, 2026

Related U.S. Application Data

(60) Provisional application No. 63/773,158, filed on Mar. 17, 2025.

(51) Int. Cl.
*A63B 102/24* (2015.01)
*A63B 71/12* (2006.01)

(52) U.S. Cl.
CPC ..... *A63B 71/1225* (2013.01); *A63B 2102/24* (2015.10)

(58) Field of Classification Search
CPC ..... A63B 71/1225; A63B 2102/24; A41D 13/0543
See application file for complete search history.

(56) References Cited

U.S. PATENT DOCUMENTS

| | | | | |
|---|---|---|---|---|
| 4,868,926 | A * | 9/1989 | Lowson | A63B 71/1225 2/22 |
| 5,080,371 | A * | 1/1992 | Karczewski | A63B 65/127 273/DIG. 18 |
| RE37,887 | E * | 10/2002 | Yates | A43B 5/18 36/71 |
| 9,073,676 | B2 * | 7/2015 | Reidel | B23P 11/00 |
| 2013/0232728 | A1 * | 9/2013 | Reidel | B65D 63/00 24/3.13 |

FOREIGN PATENT DOCUMENTS

| | | | | |
|---|---|---|---|---|
| CA | 2391099 | A1 * | 1/2004 | |
| WO | WO-9623556 | A1 * | 8/1996 | A63B 71/1225 |

* cited by examiner

*Primary Examiner* — Tajash D Patel
(74) *Attorney, Agent, or Firm* — IpHorgan Ltd.

(57) ABSTRACT

A hockey goalie leg pad has a front pad member securable to a lower leg, and a toe bridge member depending downwardly, for example by at least 1.5 inches, from a bottom of the front pad member such that an intermediate front face portion of the toe bridge member is recessed from the front bottom edge by a prescribed offset distance of at least one inch, thereby defining a pocket to partly recess a goal post therein. The increased rearward offset of the toe bridge member together with increased height of the toe bridge member, and an optional concave front face on the toe bridge member, collectively contribute to a deep C-shaped profile receiving a substantial portion of the goal post nested therein, for example 130 or more degrees of the circular boundary. This improves anchoring relative to a post to minimize post gaps and pushing off the post.

12 Claims, 4 Drawing Sheets

HOCKEY GOALIE LEG PAD WITH TOE BRIDGE MEMBER FOR ENGAGING A GOAL POST

This application claims the benefit under 35 U.S.C. 119 (e) of U.S. provisional application Ser. No. 63/773,158, filed Mar. 17, 2025.

FIELD OF THE INVENTION

The present invention relates to a goalie leg pad for a hockey goalie, and more particularly the present invention relates to a configuration of the toe bridge that secures the goalie leg pad to the toe of a skate of the goalie so that the toe bridge assists in anchoring the goalie leg pad relative to a goal post, for example when the goalie leg pad is laid on one side along an ice surface in a butterfly stance of the goalie.

BACKGROUND

In the sport of hockey, a goalie typically wears leg pads on their legs having large rectangular front pad members suitable for deflecting pucks. A flexible toe bridge member typically extends from the bottom of each front pad member to provide an anchoring location for ties that secures the bottom of the leg pad relative to the toe of the skate boot of the goalie.

A common stance used by goalies during game play is a butterfly stance in which the goalie typically lays inner side surfaces of the leg pads along the ice surface to cover the lower area of the goal. When game play proceeds to one side of the goal, it is common for goalies to snug up to the corresponding goal post to minimize any gaps where a puck can get through between the goalie and the goal post. This can involve abutting the toe area of the skate against the goal post in an attempt to position the bottom of the leg pad close to the goal post; however, the shape of skate is not well suited for accurate positioning relative to a goal post such that an undesirable gap may remain. Furthermore, when game play moves across the front of the goal area, it is desirable for the goalie to push off of the adjacent goal post to follow the game play; however, poor positioning of the skate and/or leg pad relative to the goal post may inhibit the ability of the goal to push off the post.

SUMMARY OF THE INVENTION

According to one aspect of the invention there is provided a goalie leg pad for a goalie in a game of hockey, the goalie leg pad comprising:

- a front pad member including (i) a knee portion for covering a knee of the goalie, (ii) a lower leg portion below the knee portion for covering a lower leg of the goalie, (iii) a thigh portion above the knee portion for extending above the knee of the goalie, and (iv) a foot portion extending downwardly and forwardly from the lower leg portion to a front bottom edge of the foot portion for extending over the foot of the user, (v) wherein the front bottom edge defines a leading front edge of the front pad member;
- a mounting arrangement extending rearwardly of the front pad member and arranged for securement about the lower leg of the goalie; and
- a toe bridge member depending downwardly from a bottom of the front pad member such that an intermediate portion of a front face of the toe bridge member is recessed rearwardly from the front bottom edge by a prescribed offset distance of at least one inch so as to define a pocket between the front face and the bottom of the front pad member arranged to receive a goal post partly recessed therein during a butterfly stance of the goalie.

Preferably, the toe bridge member depends downwardly from the bottom of the front pad member by a height of at least 1.5 inches.

The prescribed offset distance is preferably at least 1.25 inches.

The front face of the toe bridge member may define a concave profile between a top and a bottom of the toe bridge member.

By increasing the rearward offset of the toe bridge member together with increasing the height of the toe bridge member, along with an optional concave front face on the toe bridge member, a resulting pocket is defined between the toe bridge member and the bottom of the foot portion of the front pad member. More particularly, the resulting pocket has a deep C-shaped profile receiving a substantial portion of the goal post nested therein, for example 130 or more degrees of the circular boundary can be nested in the pocket. This improves anchoring or locking of the leg pad relative to a goal post, for example when an inner side surface of the goal pad is laid along the ice in a butterfly type stance of the goalie. The improved anchoring or locking of the leg pad to the goal post minimizing gaps as the goalie moves relative to the goal post, while improving the ability to push off the post.

When the toe bridge member comprises a rigid inner block and an outer cover extending over the inner block, the inner block preferably includes a leading face defining the concave profile of the front face of the toe bridge member.

The front face of the toe bridge member may include an upper portion above the intermediate portion protruding forwardly relative to the intermediate portion, in which the upper portion, the intermediate portion and the bottom of the front pad member collectively define a concave profile of said pocket.

When the toe bridge member comprises a rigid inner block and an outer cover extending over the inner block, the inner block may include a leading face defining the upper portion and the intermediate portion of said concave profile.

The front face of the toe bridge member preferably includes a lower portion below the intermediate portion protruding forwardly relative to the intermediate portion, in which the lower portion, the intermediate portion, and the bottom of the front pad member collectively define a concave profile of said pocket.

The goalie leg pad is suited for use in combination with a goal post having a diameter of 2 inches, in which said pocket is sized to receive at least 130 degrees of a circular boundary of the goal post nested therein. More preferably, said pocket is sized to receive at least 150 degrees of the circular boundary of the goal post nested therein.

When the toe bridge member comprises a rigid inner block and an outer cover extending over the inner block, the rigid inner block may comprise an expanded polypropylene foam, for example having a density of at least 3 pounds per cubic foot.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
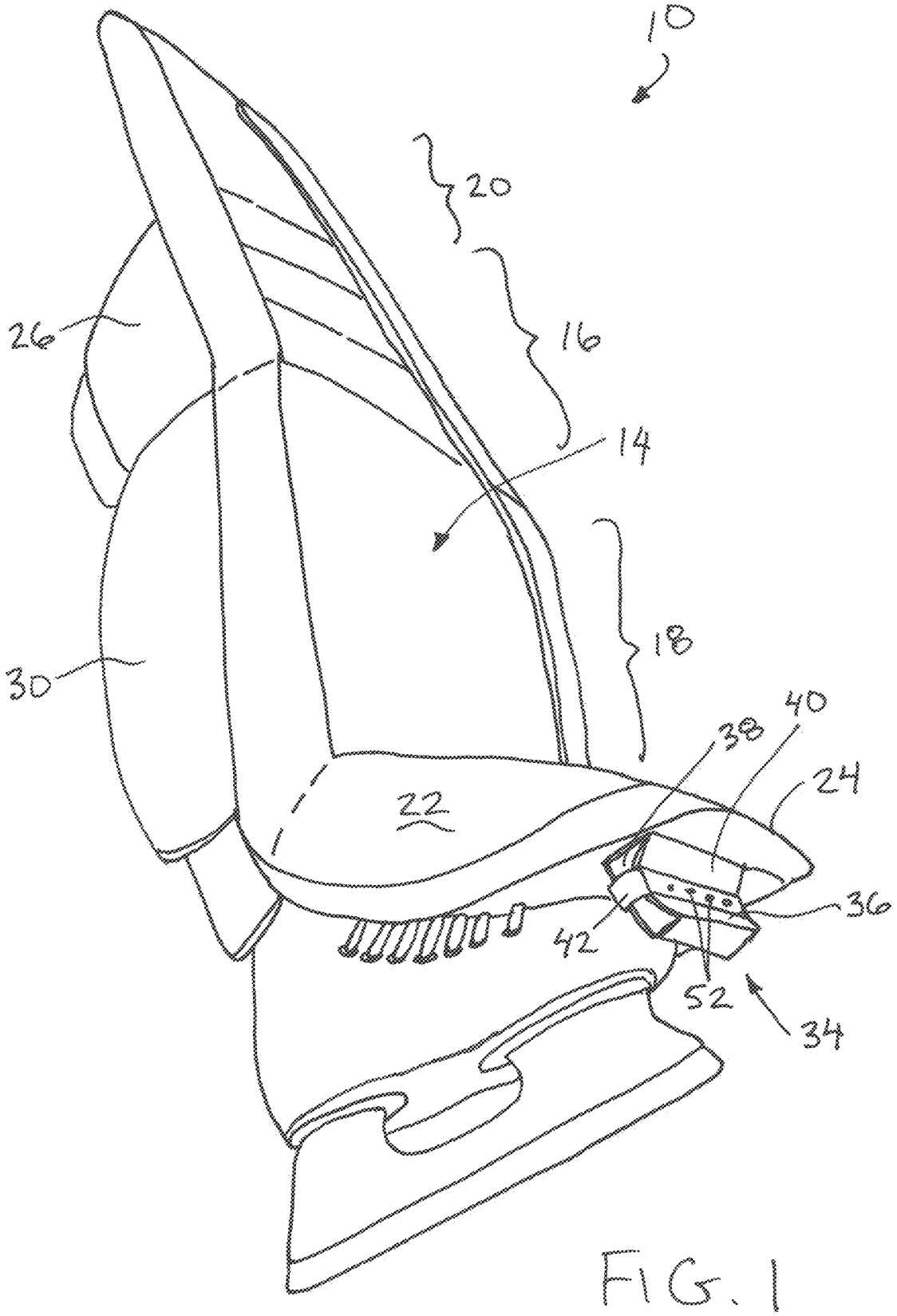
FIG. 1 is a bottom front perspective view of a goalie leg pad including a toe bridge member according to the present invention, shown worn on the left leg of a goalie.
Figure 3:
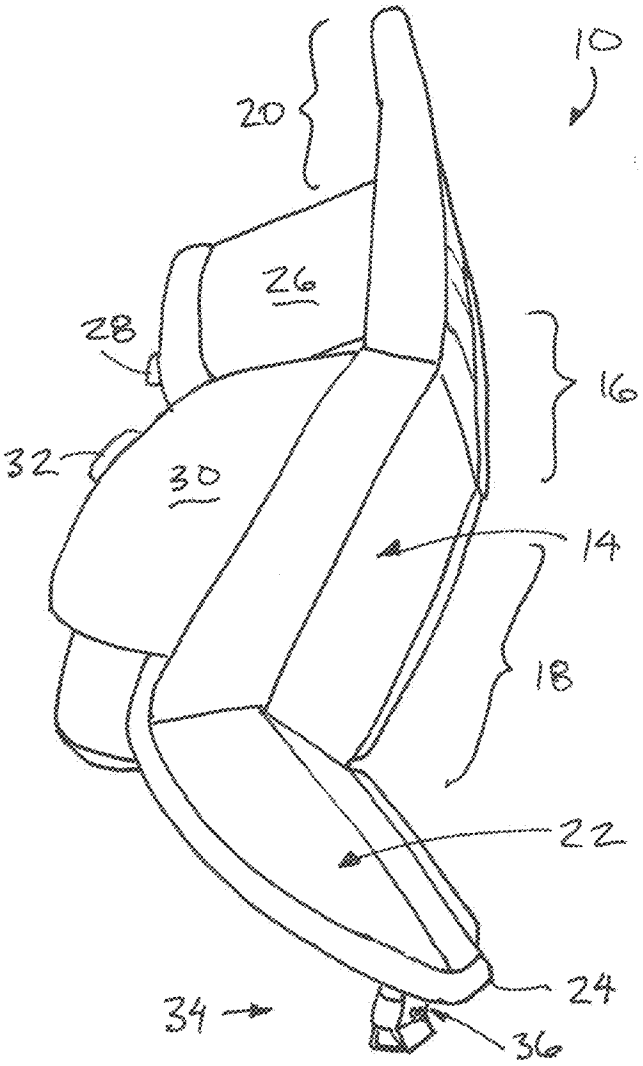
FIG. 3 is a view of an inner side of the goalie leg pad according to the embodiment of FIG. 1.
Figure 2:
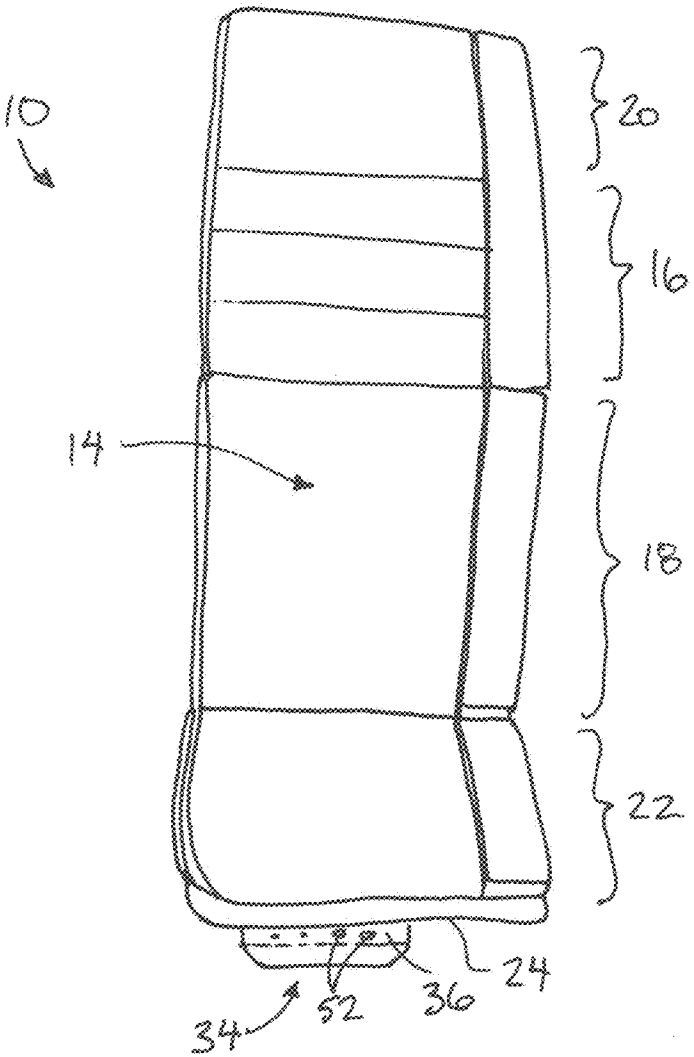
FIG. 2 is a front elevational view of the goalie leg pad according to the embodiment of FIG. 1.
Figure 4:
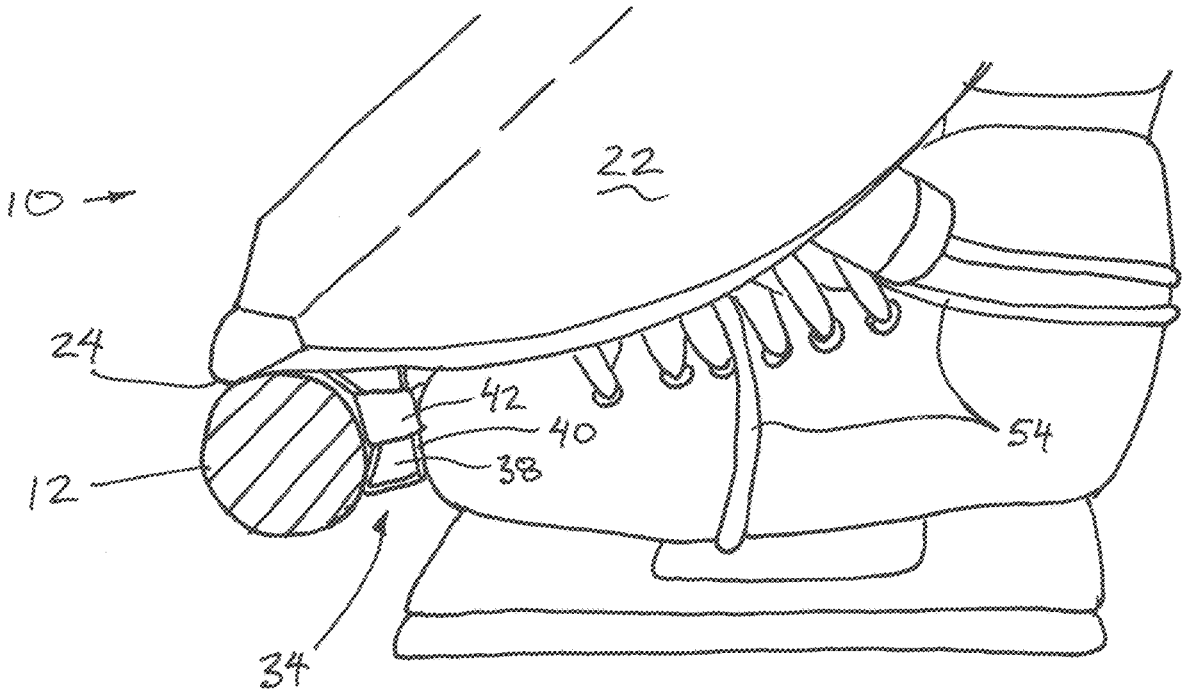
FIG. 4 is a top view of the goalie leg pad according to the embodiment of FIG. 1, in which the goalie leg pad is shown laying on the ice surface with the toe bridge member abutted against a goal post.
Figure 5:
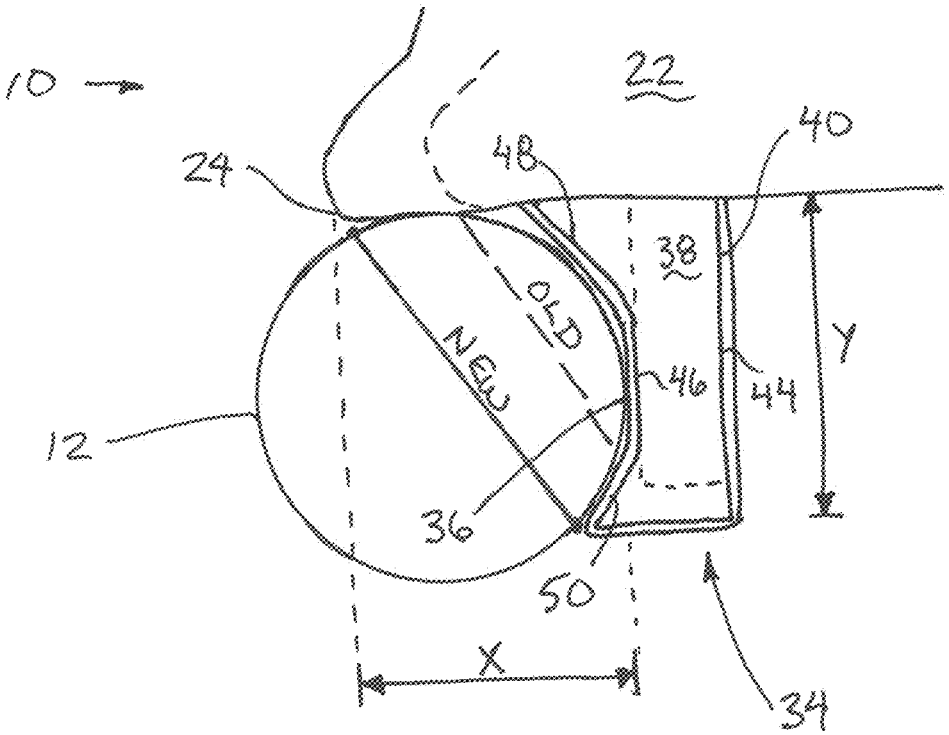
FIG. 5 is a scaled reproduction of the toe bridge member relative to a conventional 2-inch diameter goal post in which the depth of the goal post pocket is compared to a prior art leg pad represented in broken line.
Figure 6:
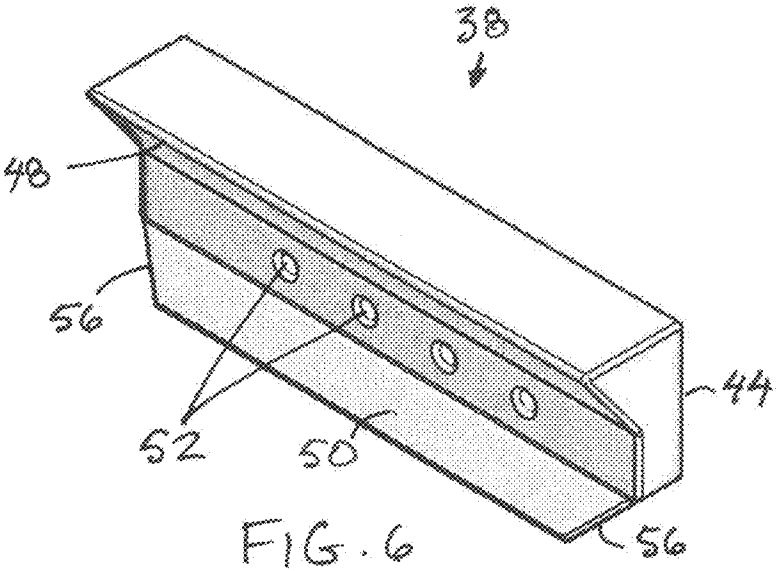
FIG. 6 is a perspective view of the inner block of the toe bridge member of the goalie leg pad according to the embodiment of FIG. 1.
Figure 9:
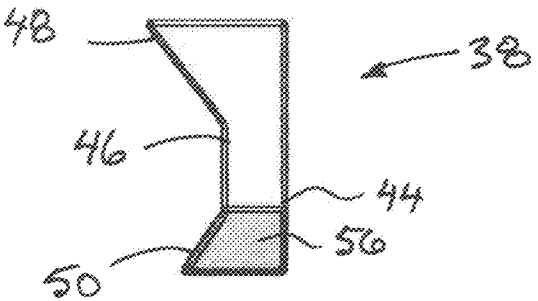
FIG. 9 is a side elevational view of the inner block of FIG. 6.
Figure 7:
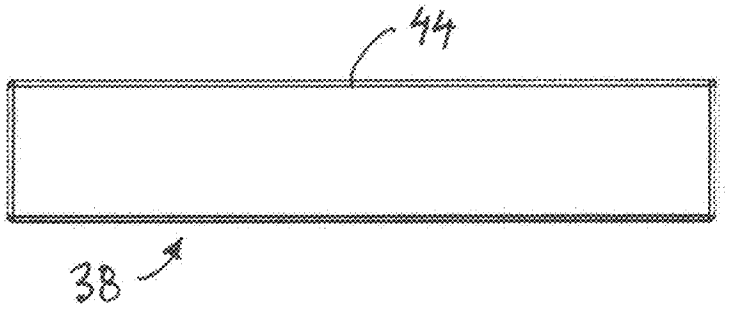
FIG. 7 is a top plan view of the inner block of FIG. 6.
Figure 8:
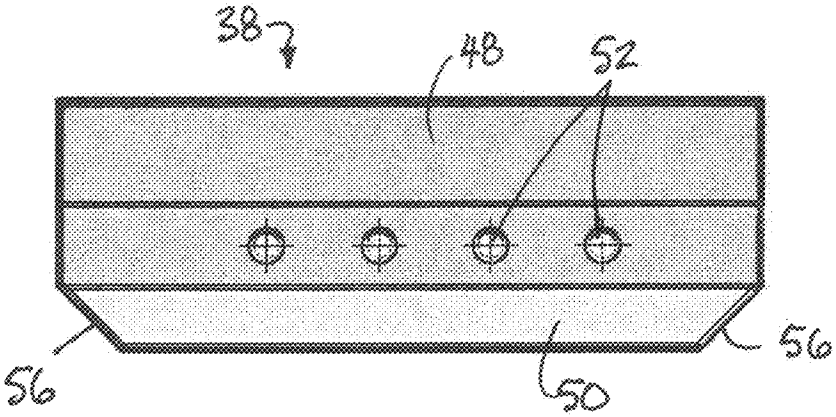
FIG. 8 is a front elevational view of the inner block of FIG. 6.

Referring to the accompanying figures there is illustrated a goalie leg pad generally indicated by reference numeral 10. The goalie leg pad 10 is particularly suited for being worn by a goalie in the sport of ice hockey. The goalie leg pad 10 is characterized by a goal post pocket formed below the front of the pad for receiving a goal post 12 nested partly therein as best shown in FIGS. 4 and 5. The goal post pocket is formed when the goalie assumes a butterfly stance or a partial butterfly stance in which the leg pads are positioned with inner side surfaces of the leg pads laying along the ice surface so that inserting the goal post into the goal post pocket anchors the leg pad relative to the goal post.

Although a left leg pad to be worn on the left leg of the goalie is shown in the figures, the goalie would typically also wear a corresponding right leg pad on the right leg which is symmetrical but otherwise identical to the left leg pad shown in the figures.

The goalie leg pad 10 generally includes a front pad member 14 which is generally rectangular when viewed from the front for spanning the front side of the leg pad across a full height and a full width in the lateral direction of the pad. The front pad member 14 is typically formed of a dense foam material with an external covering over the foam core material. According to the illustrated embodiment, the front pad member 14 generally includes (i) a knee portion 16 for covering the knee of the goalie, (ii) a lower leg portion 18 extending below the knee portion for covering the shin or lower leg of the goalie, (iii) a thigh portion 20 rising upwardly from the knee portion for covering a lower thigh area of the goalie, and (iv) a foot portion 22 also referred to as a boot portion, extending generally downwardly and forwardly from the bottom of the lower leg portion 18 for covering the top of the skate boot and which may include extending partly over the toe. The foot portion 22 terminates at a bottom front edge 24 located at the bottom of the front pad member 14 and defining the front leading edge of the pad.

At the rear of the front pad member 14, a knee pocket is formed rearwardly of the knee portion 16 to receive the knee of the goalie nested therein between lateral knee pads 26 at opposing sides of the knee pocket. A knee strap 28 extend about the rear of the knee to assist in securing the leg pad relative to the leg. A leg channel is also formed at the rear of the lower leg portion 18 between lateral leg pads 30 at opposing sides of the pad member to receive the lower leg of the goalie therein. Additional leg straps 32 further assist in securing the leg pad relative to the leg of the goalie.

The goalie leg pad 10 further includes a toe bridge member 34 mounted on the bottom side of the foot portion 22 of the front pad member 14. The toe bridge member is narrower in width than the front pad member and is situated at an intermediate location spaced inwardly from both of the laterally opposing sides of the front pad member. The toe bridge member 34 is elongated in a lateral direction of the leg pad while extending downwardly from the bottom of the foot portion at a location which is spaced rearwardly from the bottom front edge 24 by a prescribed rear offset distance represented by X in FIG. 5. The front face 36 of the toe bridge member 34 is generally concave in profile between top and bottom edges of the toe bridge member such that the rear offset distance X is measured from the rearmost portion of the front face at a central location along the height of the toe bridge member.

The toe bridge member 34 is constructed of an inner core block 38 formed of rigid foam which is mostly covered by a cover sheet 40 of a durable yet pliable material, for example leather. The inner core block 38 thus primarily dictates the shape of the toe bridge member including the concave profile of the front face. In the preferred embodiment, the inner block 38 is formed of an expanded polypropylene foam which is compressed to have a density greater than 3 pounds per cubic foot and preferably near 3.5 pounds per cubic foot. The cover sheet 40 is wrapped around the rear, bottom and front faces of the inner block 38 while being anchored to the bottom surface of the foot portion of the front pad member at the top rear and top front of the toe bridge member to suitably anchor the toe bridge member in fixed position relative to the front pad member 14. The cover sheet 40 forms a sleeve having a cross-sectional profile similar to that of the block so that the block can be received laterally slidably into the sleeve formed by the cover sheet. A lateral strap 42 partly encloses the ends of the sleeve to contain the inner block 38 within the cover sheet 40.

The toe bridge member 34 is shaped such that the rear side 44 of the toe bridge member is flat along the full height of the toe bridge member and is oriented perpendicularly to the flat top side of the toe bridge member. When the flat top of the toe bridge member is anchored flat against the bottom of the foot portion 22 of the front pad member 14, the flat rear surface 44 extends approximately perpendicularly downward from the foot portion above. In the illustrated embodiment, the overall height of the bridge member is largely dictated by the height of the inner block 38 which is approximately 43 mm.

The front face of the toe bridge member 34 defining the concave profile of the goal post pocket includes (i) an intermediate portion 46, (ii) an upper portion 48 above the intermediate portion 46, and (iii) a lower portion 50 below the intermediate portion. The intermediate portion 46 of the front face spans the full width while being parallel to the rear wall 44 at a central location along the height of the inner block so that a minimum thickness of the inner block is defined at the intermediate portion having a thickness of approximately 11 mm. The intermediate portion 46 is spaced below the top of the toe bridge member by the height of the upper portion 48 which is approximately 18 mm. The intermediate portion 46 defines the rearmost portion of the front face from which the prescribed rear offset distance X is measured.

The upper portion 48 of the front face is sloped upwardly and forwardly from the top of the intermediate portion 46 to meet the top wall of the inner block at an interior angle of less than 60 degrees, for example approximately 52 degrees. The forward apex at the intersection of the upper portion 48 and the top wall of the inner block is anchored into a corresponding interior angle of the surrounding sleeve formed by the cover sheet 40 joined to the bottom of the foot portion of the front pad member 14 to provide an anchoring location for the toe bridge member at a location spaced forwardly from the front face of the intermediate portion 46 to better resist against rearward pivoting of the toe bridge member relative to the front pad member, for example when pushing off a goal post.

The lower portion 50 of the front face is sloped downwardly and forwardly from the intermediate portion 46 to a bottom front edge of the toe bridge member which is forwardly of the intermediate portion 46 of the front face. The lower portion is sloped at a slope of greater than 50 degrees from the bottom surface, corresponding to a slope of less than 40 degrees from the vertical rear face of the toe bridge member.

The orientation of the upper portion 48, intermediate portion 46 and lower portion 50 of the front face of the toe bridge member together with the bottom of the front pad 14 extending forwardly of the toe bridge member collectively form a C shaped concave profile of the goal post pocket suitable for receiving the goal post partially nested therein.

The toe bridge member 34 further includes a plurality of fastener apertures 52 extending fully through the inner block 38 and the cover sheet 40 between the front side and the rear side of the toe bridge member so that the fastener apertures 52 are laterally spaced apart from one another while being aligned in a common row extending laterally across the intermediate portion 46 of the toe bridge member. The fastener apertures 52 receive suitable fasteners therethrough for fastening one or more ties 54 used for tying the front of the foot portion 22 of the front pad member 14 relative to the skate.

The bottom corners 56 of the toe bridge member 34 at laterally opposing ends of the toe bridge member are truncated such that the opposing ends of the toe bridge member are tapered downwardly and inwardly relative to one another. Although the toe bridge member 34 described herein may be stiffer and larger than conventional toe bridges, the tapered ends ensure that the larger block of material will not engage the ice surface in an interfering manner when the goalie is pushing off of the ice at a low angle of the leg pad relative to the ice surface for example.

Turning now more particularly to FIG. 5, the prescribed rear offset distance X is increased relative to conventional leg pads to be greater than 1 inch, and preferably greater than 1.25 inches, for example in the order of 1.5 inches according to the illustrated embodiment. The overall height of the toe bridge member 34 relative to the bottom of the front pad member 14 is also further increased relative to conventional leg pads to be greater than 1.5 inches, and preferably greater than 1.6 inches, for example in the order of 1.7 inches according to the illustrated embodiment.

The increased height and rear offset of the toe bridge member 34, together with the concave profile of the front face results in a goal post pocket in which the concave profile has a radius in the range of 2 to 2.5 inches and more preferably in the range of 2 to 2.25 inches so as to be well-suited for receiving a goal post having a 2 inch diameter snugly therein. Furthermore the concave profile of the goal post pocket extends about the circular boundary of the goal post along an arc of at least 110 degrees, or more preferably at least 130 degrees, or yet more preferably at least 150 degrees. According to the illustrated embodiment, the concave profile of the goal post pocket extends about the circular boundary of the goal post along an arc of 170 degrees. The increased size of the goal post pocket formed between the toe bridge member and the bottom of the front pad member allows a significantly larger portion of the circumference of the goal post to be nested therein, which in turn better anchors the leg pad relative to the goal post.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A goalie leg pad for a goalie in a game of hockey, the goalie leg pad comprising:

a front pad member including (i) a knee portion for covering a knee of the goalie, (ii) a lower leg portion below the knee portion for covering a lower leg of the goalie, (iii) a thigh portion above the knee portion for extending above the knee of the goalie, and (iv) a foot portion extending downwardly and forwardly from the lower leg portion to a front bottom edge of the foot portion for extending over the foot of the user, (v) wherein the front bottom edge defines a leading front edge of the front pad member;

a mounting arrangement extending rearwardly of the front pad member and arranged for securement about the lower leg of the goalie; and a toe bridge member depending downwardly from a bottom of the front pad member such that an intermediate portion of a front face of the toe bridge member is recessed rearwardly from the front bottom edge by a prescribed offset distance of at least one inch so as to define a pocket between the front face and the bottom of the front pad member arranged to receive a goal post partly recessed therein during a butterfly stance of the goalie.

2. The goalie leg pad according to claim 1 wherein the prescribed offset distance is at least 1.25 inches.

3. The goalie leg pad according to claim 1 wherein the toe bridge member depends downwardly from the bottom of the front pad member by a height of at least 1.5 inches.

4. The goalie leg pad according to claim 1 wherein the front face of the toe bridge member defines a concave profile between a top and a bottom of the toe bridge member.

5. The goalie leg pad according to claim 4 wherein the toe bridge member comprises a rigid inner block and an outer cover extending over the inner block, wherein the inner block includes a leading face defining the concave profile of the front face of the toe bridge member.

6. The goalie leg pad according to claim 1 wherein the front face of the toe bridge member includes an upper portion above the intermediate portion protruding forwardly relative to the intermediate portion, wherein the upper portion, the intermediate portion and the bottom of the front pad member collectively define a concave profile of said pocket.

7. The goalie leg pad according to claim 6 wherein the toe bridge member comprises a rigid inner block and an outer cover extending over the inner block, wherein the inner block includes a leading face defining the upper portion and the intermediate portion of said concave profile.

8. The goalie leg pad according to claim 1 wherein the front face of the toe bridge member includes a lower portion below the intermediate portion protruding forwardly relative to the intermediate portion, wherein the lower portion, the intermediate portion and the bottom of the front pad member collectively define a concave profile of said pocket.

9. The goalie leg pad according to claim 1 wherein the goal post has a diameter of 2 inches and wherein said pocket is sized to receive at least 130 degrees of a circular boundary of the goal post nested therein.

10. The goalie leg pad according to claim 9 wherein said pocket is sized to receive at least 150 degrees of the circular boundary of the goal post nested therein.

11. The goalie leg pad according to claim 1 wherein the toe bridge member comprises a rigid inner block and an outer cover extending over the inner block, the rigid inner block comprising an expanded polypropylene foam.

12. The goalie leg pad according to claim 11 wherein the rigid inner block has a density of at least 3 pounds per cubic foot.

* * * * *